United States Patent [19]

Fischer

[11] 4,418,620

[45] * Dec. 6, 1983

[54] OFFSET PRINTING MACHINE INK DISTRIBUTION AND DRYING SYSTEM

[75] Inventor: Hermann Fischer, Augsburg, Fed. Rep. of Germany

[73] Assignee: M.A.N.-ROLAND Druckmaschinen Aktiengesellschaft, Offenbach am Main, Fed. Rep. of Germany

[ * ] Notice: The portion of the term of this patent subsequent to Mar. 16, 1999 has been disclaimed.

[21] Appl. No.: 366,239

[22] Filed: Apr. 7, 1982

Related U.S. Application Data

[63] Continuation of Ser. No. 186,423, Sep. 12, 1980, abandoned.

[30] Foreign Application Priority Data

Oct. 23, 1979 [DE] Fed. Rep. of Germany ..... 2942691

[51] Int. Cl.[3] ..... B41F 31/10; B41F 7/12

[52] U.S. Cl. ..... 101/350; 101/148

[58] Field of Search ..... 101/147, 148, 349, 350, 101/351, 352, 363, 364, 340, 341, 344, 345, 355, 356, 357, 360, 361, 204, 205, 206, 207–210, 342, 343, 346, 348, 353, 354, 358, 359; 118/262, 258

[56] References Cited

U.S. PATENT DOCUMENTS

| | | | |
|---|---|---|---|
| 2,821,133 | 1/1958 | Brodie | 101/349 X |
| 3,150,589 | 9/1964 | Senogles | 101/349 X |
| 3,261,287 | 7/1966 | Brodie | 101/350 |

FOREIGN PATENT DOCUMENTS

| | | | |
|---|---|---|---|
| 1904531 | 5/1963 | Fed. Rep. of Germany | 101/349 |
| 2654007 | 6/1978 | Fed. Rep. of Germany | 101/349 |
| 2902047 | 7/1979 | Fed. Rep. of Germany | 101/349 |

*Primary Examiner*—J. Reed Fisher

*Attorney, Agent, or Firm*—Frishauf, Holtz, Goodman & Woodward

[57] ABSTRACT

To increase the surface area of ink picked up from a cylinder of the ink train, which ink may have been contaminated with wetting water, and to insure evaporation of the wetting water, a cage-like holder with ventilating openings therein has two rollers, spaced from each other, in surface-friction and rolling engagement with an oscillating cylinder of the ink train, and further retains a plurality of roller elements, preferably balls, but which may be pins, rollers, or cylinders, in floating, self-aligning, centerless position within the cage, so that ink, contaminated with water, picked up by one of the ink transferring rollers, will coat the roller elements therein to provide a substantial surface area for evaporation of water carried thereby. If needed, an air blast can be directed to the cage to increase the evaporation effect.

15 Claims, 1 Drawing Figure

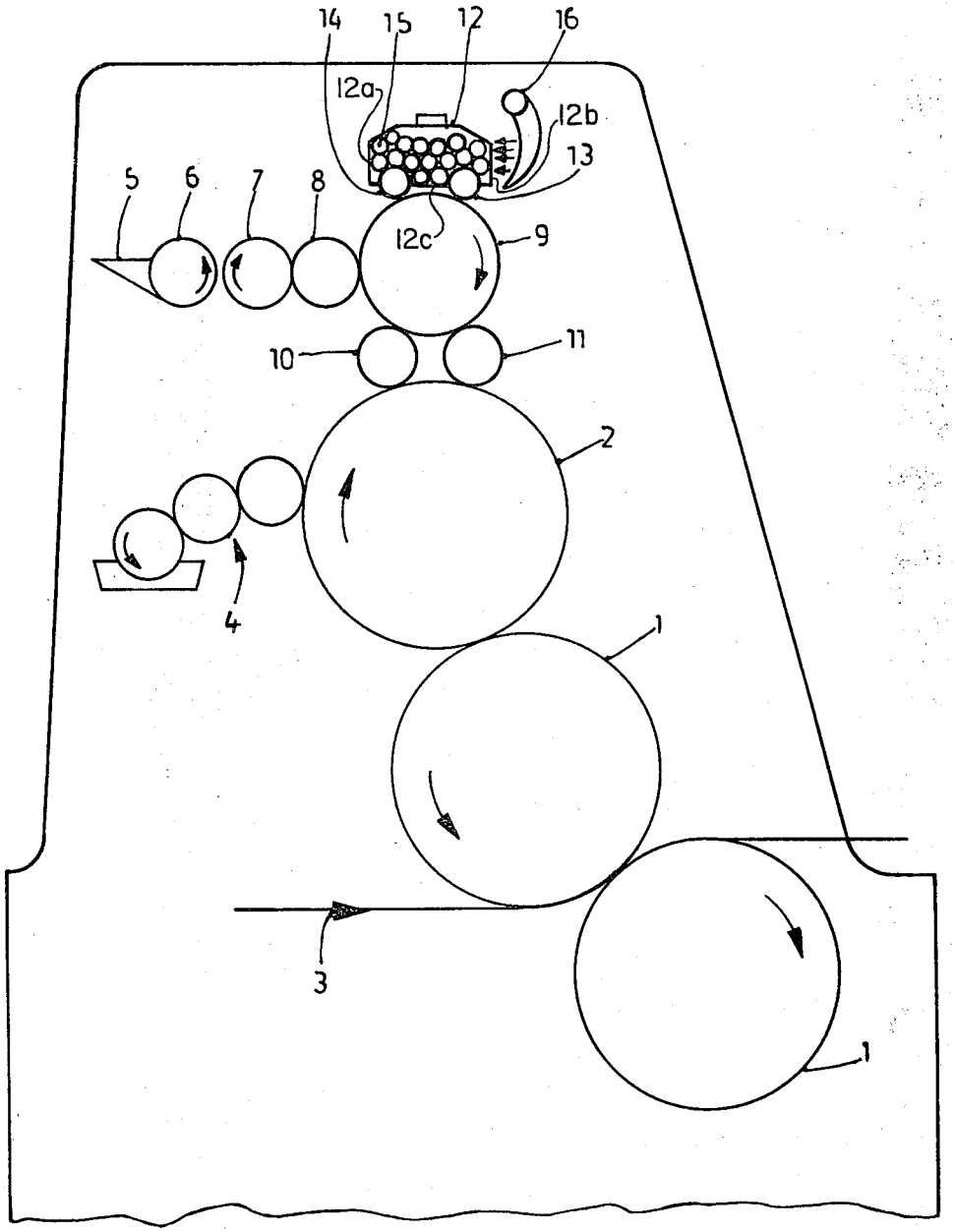
14
15
12
16
12a
12b
13
5
6
7
8
12c
9
10
11
2
4
1
3
1

OFFSET PRINTING MACHINE INK DISTRIBUTION AND DRYING SYSTEM

This is a continuation of application Ser. No. 186,423 filed Sept. 12, 1980, now abandoned.

The present invention relates to offset printing machines, and more particularly to the ink distribution system thereof which is arranged to provide for excellent uniformity of ink distribution and separation of ink and wetting liquid, typically water.

BACKGROUND AND PRIOR ART

In offset rotary printing presses, it is highly desirable to prevent penetration of wetting liquid, typically water, in the inking system or inking fountain. One such arrangement to prevent penetration of water is shown in German Utility Model DE-GM 19 04 531. This arrangement provides an additional axially rubbing roller which is beyond the roller train of the inking system, and which is not used for ink transfer. The additional roller is surrounded over part of its circumference by an air blast trough or box or shroud, which provides a stream of drying air in order to dry ink which is transferred to the surface of the additional roller, and which may contain moisture. The publication points out that the diameter of this additional roller must be dimensioned to be of sufficient size so that any wetting liquid which may adhere thereon will be reliably evaporated; the air blast trough of box or shroud which, in part, surrounds this additional roller, should surround a major portion of the circumference of the additional roller. Even if the additional roller is made of substantial size, the surface available to dry ink applied thereto is limited. The quantity of air being supplied thus must be substantial in order to effect the required drying.

THE INVENTION

It is an object to provide a drying and ink distribution system which provides a surface of sufficient size to permit effective evaporation of any wetting liquid which may become mixed or adhered to the ink without requiring excessive drying air supply or, preferably, operating without any additional drying air.

Briefly, in accordance with the invention, a cage element is provided formed with ventilation openings, the cage element including a plurality of contacting roller elements of essentially circular diameter, such as balls, roller pins, rollers, or the like, which are in floating rolling contact with at least one drive roller located on a side of the cage, preferably with two drive rollers placed at opposite lateral sides of the cage, and which are driven from an inking roller.

Freely rotatable rolling elements within a cage, formed with ventilating openings, provide substantially improved evaporation of ink adhering to the roller elements within the cage. Whether the roller elements are balls, pins, cylinders, rollers, or the like, the surface is nevertheless substantially greater than that of any single cylinder which can be reasonably provided in an apparatus. The evaporating surface, thus, is large. Use of balls within a cage results in particularly good ventilation therethrough and thus in a maximum drying effect.

The rollers within the cage do not require any bearings i.e., they are positioned in the cage in floating centerless manner. They do not require any separate drive. They are driven by frictional engagement with each other, and with the drive roller or rollers from one of the inking fountain cylinders. The cage, with the rolling elments therein, can be simple and is inexpensive.

Drying air can be supplied in the form of a compressed air flow through the ventilation openings of the roller, if required; in many instances, however, a cage which has many ventilation openings is sufficient without any additional drying air blast or supply being needed.

DRAWING

The single FIGURE is a highly schematic side view of a portion of a rotary offset printing machine with an inking fountain which includes the ink distribution and drying system in accordance with the present invention.

The drawing illustrates, schematically, the upper portion of the printing system of an offset rotary printing press. In accordance with standard construction, the rotary printing press has a blanket cylinder 1 and a plate cylinder 2. A web 3, on which printing is to be effected, is guided between the rubber cylinder 1 and an opposite rubber cylinder 1' which may contain a further printing system. The plate cylinder 2 receives wetting liquid from a wetting fountain system 4 which is located in advance of the inking fountain—looked at in the direction of rotation of the plate cylinder 2, as indicated by the respective arrows in the FIGURE. The wetting fountain system can be of any standard construction.

The inking formation has an ink trough 5 in which an ink transfer roller 6 is placed. The ink transfer roller 6 transfers ink to an ink receiving roller 7, for example by repetitive contact in the form of a ductor roller, or the like. The receiving roller 7 transfers ink over another transfer roller 8 to an axially oscillating distribution cylinder 9. The ink distribution cylinder 9 is in surface engagement with ink application rollers or cylinders 10, 11, in order to ink the plate cylinder 2.

The foregoing arrangement of a rotary offset printing machine is essentially standard.

In accordance with the present invention, a cage 12 is placed adjacent the ink distribution cylinder 9. The cage 12 retains a plurality of roller elements having circular cross section. The roller elements are located adjacent each other, laterally next to each other, and above each other; they may be in the form of balls, cylinders, or rollers, or pins. The roller elements have surfaces which are ink receptive. Adjacent the end sides **12*a*, 12*b* of the cage 12 and passing through bottom wall 12*c*, transfer rollers 13, 14 are located which have a diameter substantially larger than the diameters of the roller elements 15. The distance between rollers 13, 14 extends over a portion of the circumference of cylinder 9, which has a diameter substantially larger than the diameter of rollers 13, 14. Ink picked up by the rollers 13, 14 will be transferred into the interior of the cage 12. Ink transport is effected by rotation of the roller elements 13, 14 due to friction of surface contact engagement thereof with the cylinder 9. This ink is transferred to the roller element 15. The lateral roller elements 13, 14, larger than the remainder of the roller elements 15, extend beyond the bottom side of the cage 12. The entire unit 12, with the roller elements 15 therein, and the lateral rollers 13, 14, can be placed on a cylinder 9** similar to a rider or idler roller, so that all the rotating elements within the cage are easily and readily driven. The entire unit can be made as an attachment which can be applied to existing inking cylinders in existing machines.

The number of the roller elements 15, including the drive rollers 13 and 14 within the cage 12 is substantial. Thus, a high overall surface area is provided, which results in excellent evaporation of excess wetting liquid which may have become mixed with or adhered to the ink.

The cage 12 has ventilating openings, for example in form of holes thereabout (not shown separately), or the cage may be made, at least in part, of a mesh, grid or sieve material. If the cage is essentially solid, ventilation openings on at least one of the side walls, and preferably placed to provide for cross ventilation, is a preferred arrangement. Frequently it is sufficient to provide apertures in the side walls in order to obtain the required drying effect.

If necessary, and with high use of wetting water, a blower arrangement 16 can be placed adjacent the cage 12 to direct a stream of evaporating air into and through the cage 12 to further increase evaporation of wetting water therein and enhance drying of the ink transferred into the cage.

Cage 12 results in efficient drying of ink received by the roller element 14 and picked up from the surface of cylinder 9 which, after drying, is returned to the surface of the cylinder 9 by the roller 13. In a preferred form, the roller elements 15 are balls, since this results in optimal ventilation of the container or cage 12. The roller elements 13, 14 preferably are pins, rollers or cylinders extending, for example, across the length of the cylinder 9 and, preferably, slightly longer if cylinder 9 is oscillating so as to cover the entire oscillating path of the surface of the cylinder 9.

The drying and ink distribution system can be used with various types of inking fountain systems, for example with inking systems using ductor rollers, film systems, and the like. Likewise, the wetting fountain system can be of any type, such as film fountain systems, wetting ductor roller systems, and the like. The cage 12 and the rollers therein can be applied, as desired, to selected rollers or cylinders which are part of the wetting fountain system both of the film type as well as of the ductor type.

To insure rotation of the roller elements 15 within the cage container or holder 12, the number of roller elements therein preferably is even so that mutual friction of the roller elements 15 within the cage-like holder 12 is minimized.

I claim:

1. In an offset printing machine having a plate cylinder (2) and an inking system including an ink trough (5);

an ink duct roller (6) receiving ink from the ink trough (5);

an ink distribution roller (9);

and a plurality of ink rollers (7, 8, 10, 11) conducting ink from the ink duct roller to the ink distribution roller and from the ink distribution roller to the plate cylinder (2) and forming, with said ink distribution roller, an ink roller train, apparatus for distributing and drying ink in the ink roller train comprising a cage-like holder (12) open to the atmosphere having confining side walls and a closed bottom wall (12*c*);

two ink transferring rollers (13, 14) having an ink accepting surface projecting from the cage-like holder, and a plurality of loose roller elements (15) freely centerless floatingly located in the cage-like holder (12), for centerless, self-positioned rolling movement between the confining side walls and the bottom wall of the cage, some of the roller elements being in surface engagement with said ink transferring rollers and some of the roller elements being in surface engagement with each other to increase the surface area of ink transported in the ink train, the plurality of roller elements being of such number that the distance between the ink transferring rollers (13, 14) within the cage-like holder (12) is spanned by at least one of the roller elements, and which will assume positions between the ink transferring rollers, the plurality of roller elements (15) being rotated by surface frictional engagement with the ink transferring rollers (13, 14);

and wherein said cage-like holder (12) is positioned in said printing machine for engagement of both of the ink transferring rollers (13, 14) with spaced circumferential surface portions of said ink distribution roller (9) forming a single one of the rollers in the ink roller train, said ink transferring rollers (13, 14) having a diameter substantially less than the diameter of said one ink distribution roller (9) and being positioned to span a portion of the circumference thereof.

2. Apparatus according to claim 1, wherein said ink distribution roller (9) comprises an axially oscillating cylinder.

3. Apparatus according to claim 1, wherein said two ink transferring rollers (13, 14) have a diameter which is larger than the diameters of said roller elements (15).

4. Apparatus according to claim 1, wherein an even number of roller elements is retained in said cage-like holder.

5. Apparatus according to claim 1 further including a forced air blast blower apparatus (16) positioned for applying a stream of air to the interior of the cage-like holder (12) for providing drying air to the surfaces of the ink transferring rollers (13, 14) and the roller elements (15) in the cage-like holder (12).

6. Apparatus according to claim 1, wherein said ink distribution roller (9) of said ink train with which the ink transferring rollers (13, 14) are in contact is a roller intermediate of the plurality of rollers in the ink train to provide at least one additional roller between said ink distribution roller and the plate cylinder (2) of the offset printing machine.

7. Apparatus according to claim 1, wherein said roller elements (15) comprise balls having diameters which are small with respect to the diameter of at least one of the ink transferring rollers (13, 14).

8. Apparatus according to claim 7, further including a forced air blast blower apparatus (16) positioned for applying a stream of air to the interior of the cage-like holder (12) for providing drying air to the surfaces of the ink transferring rollers (13, 14) and the roller elements (15) in the cage-like holder (12).

9. Apparatus according to claim 6, further including a forced air blast blower apparatus (16) positioned for applying a stream of air to the interior of the cage-like holder (12) for providing drying air to the surfaces of the ink transferring rollers (13, 14) and the roller elements (15) in the cage-like holder (12).

10. In an offset printing machine having a plate cylinder and an inking system including an ink trough (5);

an ink duct rollers (6) receiving ink from the ink trough (5);

an ink distribution roller (9);

and a plurality of ink rollers (7, 8, 10, 11) conducting ink from the ink duct roller to the ink distribution roller and from the ink distribution roller and forming, with said ink distribution roller, an ink roller train, apparatus for distributing and drying ink in the ink roller train comprising a cage-like holder (12) open to the atmosphere having confining side walls and a closed bottom wall (12*c*);

at least one ink transferring roller (13, 14) having an ink accepting surface from the cage-like holder;

and a plurality of roller elements (15) having circular diameter freely, centerless floatingly located in the cage-like holder (12), for centerless, self-positioned rolling movement between the confining side walls and the bottom wall of the cage, some of said roller elements being in surface engagement with the at least one ink transferring roller (13, 14) and some of the roller elements being in surface engagement with each other, to increase the surface area of ink being transported in the ink train, wherein said at least one ink transferring roller (13, 14) is in surface contact and frictional drive engagement with the surface of only a single one (9) of the rollers, said single one of the rollers comprising said ink distribution roller (9); and said at least one ink transferring roller (13, 14) has a diameter which is larger than the diameters of said roller elements (15).

11. Apparatus according to claim 10, wherein the diameter of said at least one ink transferring roller (13, 14) is substantially less than the diameter of said one ink distribution roller (9).

12. Apparatus according to claim 10, wherein said roller elements (15) comprise balls having diameters which are small with respect to the diameter of said at least one ink transferring roller (13, 14).

13. Apparatus according to claim 10, further including a forced air blast blower apparatus (16) positioned for applying a stream of air to the interior of the cage-like holder (12) for providing drying air to the surfaces of said at least one ink transferring roller (13, 14) and the roller elements (15) in the cage-like holder (12).

14. Apparatus according to claim 10, wherein said one ink distribution roller (9) of said ink train with which the at least one ink transferring roller (13, 14) is in contact is a roller intermediate of the plurality of rollers in the ink train to provide at least one additional roller between said one ink distribution roller (9) and the plate cylinder (2) of the offset printing machine.

15. Apparatus according to claim 14, further including a forced air blast blower apparatus (16) positioned for applying a stream of air to the interior of the cage-like holder (12) for providing drying air to the surfaces at least one ink transferring roller (13, 14) and the roller elements (15) in the cage-like holder (12).

* * * * *